US008215977B2

(12) United States Patent
Zapf

(10) Patent No.: US 8,215,977 B2
(45) Date of Patent: Jul. 10, 2012

(54) ELECTRICAL PLUG-AND-SOCKET CONNECTOR WITH LOCKING MEANS

(75) Inventor: Joachim Zapf, Limburgerhof (DE)

(73) Assignee: Tyco Electronics AMP GmbH, Bensheim (DE)

( * ) Notice: Subject to any disclaimer, the term of this patent is extended or adjusted under 35 U.S.C. 154(b) by 0 days.

(21) Appl. No.: 13/144,381

(22) PCT Filed: Jan. 8, 2010

(86) PCT No.: PCT/EP2010/050140
§ 371 (c)(1),
(2), (4) Date: Jul. 13, 2011

(87) PCT Pub. No.: WO2010/081765
PCT Pub. Date: Jul. 22, 2010

(65) Prior Publication Data

US 2011/0275235 A1 Nov. 10, 2011

(30) Foreign Application Priority Data

Jan. 13, 2009 (DE) ..... 10 2009 004 458

(51) Int. Cl.
*H01R 13/627* (2006.01)

(52) U.S. Cl. ..... 439/352

(58) Field of Classification Search ..... 439/352, 439/312, 321, 317, 338, 345, 311, 304, 292; 285/360–362
See application file for complete search history.

(56) References Cited

U.S. PATENT DOCUMENTS 4,070,080 A 1/1978 Eshleman et al.
4,420,209 A 12/1983 Reis et al.
4,747,656 A 5/1988 Miyahara et al.
5,641,310 A 6/1997 Tiberio, Jr.
6,056,577 A * 5/2000 Blanchet ..... 439/352
7,306,472 B2 12/2007 Matsumoto et al.
7,413,457 B2 * 8/2008 Mehnert et al. ..... 439/321
2004/0137778 A1 7/2004 Mattheeuws et al.

FOREIGN PATENT DOCUMENTS

DE 19749130 C1 8/1999
EP 0037014 A2 10/1981

OTHER PUBLICATIONS

International Search Report and Written Opinion issued by the European Patent Office, dated Apr. 27, 2010, for PCT/EP2010/050140, 11 pages.
Search Report issued by the German Patent & Trademark Office, dated Sep. 18, 2009, for Priority Application No. DE102009004458.2, 4 pages.
International Preliminary Report on Patentability, dated Jul. 19, 2011, issued by the International Bureau of WIPO, Geneva, Switzerland, for PCT/EP2010/050140; 5 pages.

* cited by examiner

*Primary Examiner* — Renee S Luebke
*Assistant Examiner* — Harshad Patel
(74) *Attorney, Agent, or Firm* — Faegre Baker Daniels LLP

(57) ABSTRACT

In a plug-and-socket connector with a locking means having an unlocking ring, it is proposed according to the invention that the first connector element be provided in its end section with an external circumambient groove, in which the unlocking ring is rotatably guided, which ring has pockets distributed across its periphery for the catch projections of catch hooks fixed in the second connector element. The second connector element has a window-like cut-out through which the unlocking ring is accessible and can be turned in the locked state.

8 Claims, 4 Drawing Sheets

ELECTRICAL PLUG-AND-SOCKET CONNECTOR WITH LOCKING MEANS

Figure 1:
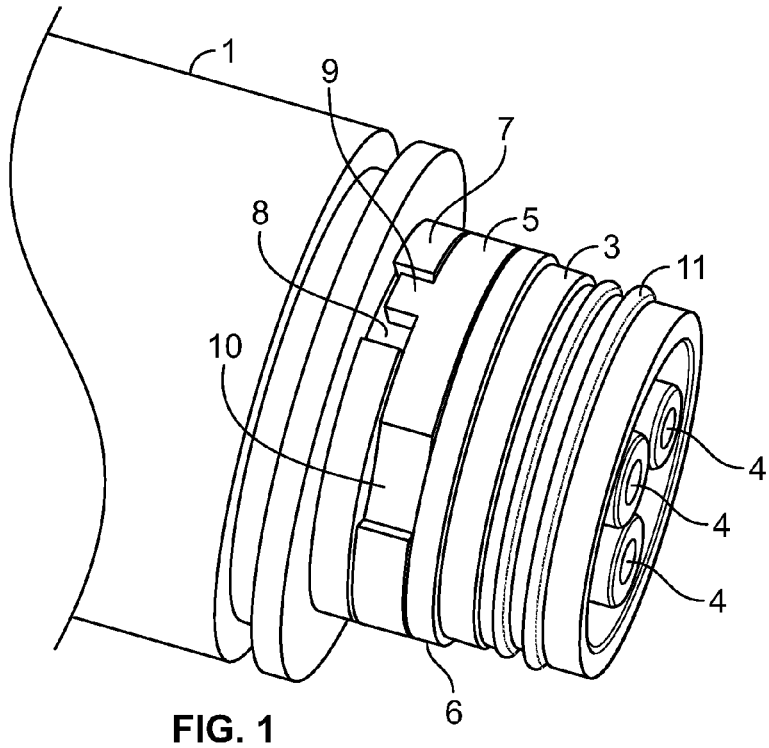

The invention relates to an electrical plug-and-socket connector with a first connector element, the end section of which can be inserted into a coaxial second connector element, and with a locking means having an unlocking ring.

A plug-and-socket connector of this type is known for example from DE 197 49 130 C1. The locking means of the known plug-and-socket connector has a cylindrical unlocking ring which surrounds the second, outer, connector element in the form of an axially displaceable unlocking sleeve. Due to axial displacement of the unlocking sleeve, the free ends of the catch tongues formed on a locking ring are pressed outwards and the plug-and-socket connector is unlocked.

The known locking means having an axially displaceable unlocking ring consist of parts of relatively complex construction which typically result in an undesirable enlargement of the external diameter of the plug-and-socket connector. Furthermore, even in the case of locking means of complicated construction it is seldom possible to check clearly, visually from the outside, whether the plug-and-socket connector is locked. The situation is made more difficult if a locking means which can be opened only with the aid of a tool is required.

The object of the invention is to provide a plug-and-socket connector with a locking means which is inexpensive to manufacture and of simple construction and in addition has good sealing properties.

This object is achieved according to the invention with the measures set forth in Claim 1. Preferred embodiments of the invention are listed in the following dependent claims.

In the plug-and-socket connector according to the invention, beyond the generic features, provision is made for the second connector element to be provided on its end section with axially extending inner grooves, in which in each case a catch hook is guided which is fixed to the second connector element and has on the connection side an inward-projecting catch projection. Furthermore, the first connector element is provided in its end section with an external circumambient groove in which the unlocking ring is rotatably guided, and the unlocking ring has pockets distributed across its periphery, the catch projections in a locked state of the plug-and-socket connector penetrating elastically into one pocket in each case and in an unlocked state being able to be pressed outwards by a section of the periphery of the unlocking ring which is not provided with pockets. Furthermore, according to the invention provision is made for the end section of the second connector element to have at least one window-like cutout through which the unlocking ring is accessible and can be turned in the locked state.

One advantage of the plug-and-socket connector according to the invention is that, apart from the two connector elements, which are only minimally influenced by the locking means and may therefore be of very simple form, and a simply formed unlocking ring, only for example three additional catch hooks are necessary as parts which have to be manufactured separately for producing the locking means. It is regarded as particularly advantageous that the catch hooks, owing to the construction of the locking means, can be designed with relatively high tolerances. The unlocking ring, in cooperation with the window-like cutout, permits simple and clear visualisation of the locked or unlocked state of the plug-and-socket connector.

An embodiment of the invention in which the catch hooks on the end opposite the catch projection have at least one anchoring projection with which they are anchored in an external circumambient annular groove on the second connector element, in which groove the axially extending inner grooves end, is particularly preferred. This permits very simple mounting of the catch hooks, which are inserted from the connection face of the second connector element into the axial grooves until they click securely in the annular groove.

According to an advantageous development of the aforementioned embodiments, three catch hooks arranged uniformly distributed on the periphery of the second connector element are provided, so that clear catching, supported at three points, is made possible.

According to one development, an unlocking member which projects in the axial direction is arranged on the unlocking ring, which member in the locked state of the plug-and-socket connector can be actuated through the window-like cutout. This variant offers advantages for simple locking and visualisation of the locked state.

The transitions of the pockets to the adjoining sections of the periphery of the unlocking ring which are not provided with pockets, according to a further embodiment, are formed obliquely at least to one side, so that an inclined thrust face which cooperates with the respective catch projection is formed.

Owing to the unlocking ring which can only be turned through the window-like cutout, it can be ensured in a simple manner that the locking means—if this is required for an application—can be unlocked only with a tool.

The first connector element may be provided on its end section with a circumambient radial seal, which is advantageous compared with an end-face seal known from the prior art.

The formation of the catch hooks such that they consist of plastics material at the catch-projection end and of metal at the opposite end is advantageous since it permits a high degree of heat dissipation and thereby a greater current transmission capability.

Figure 2:
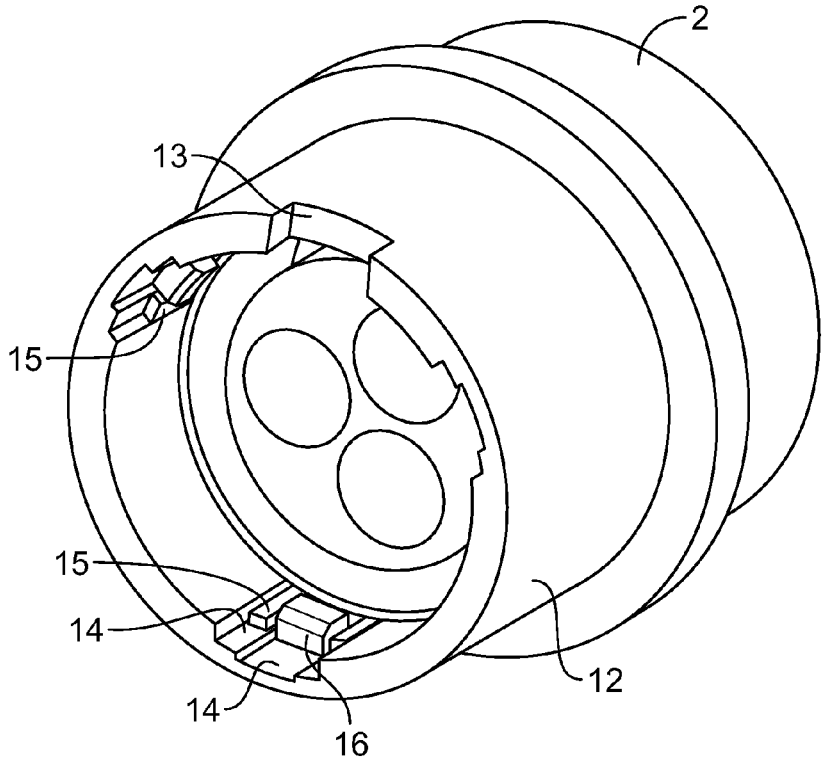
Figure 3:
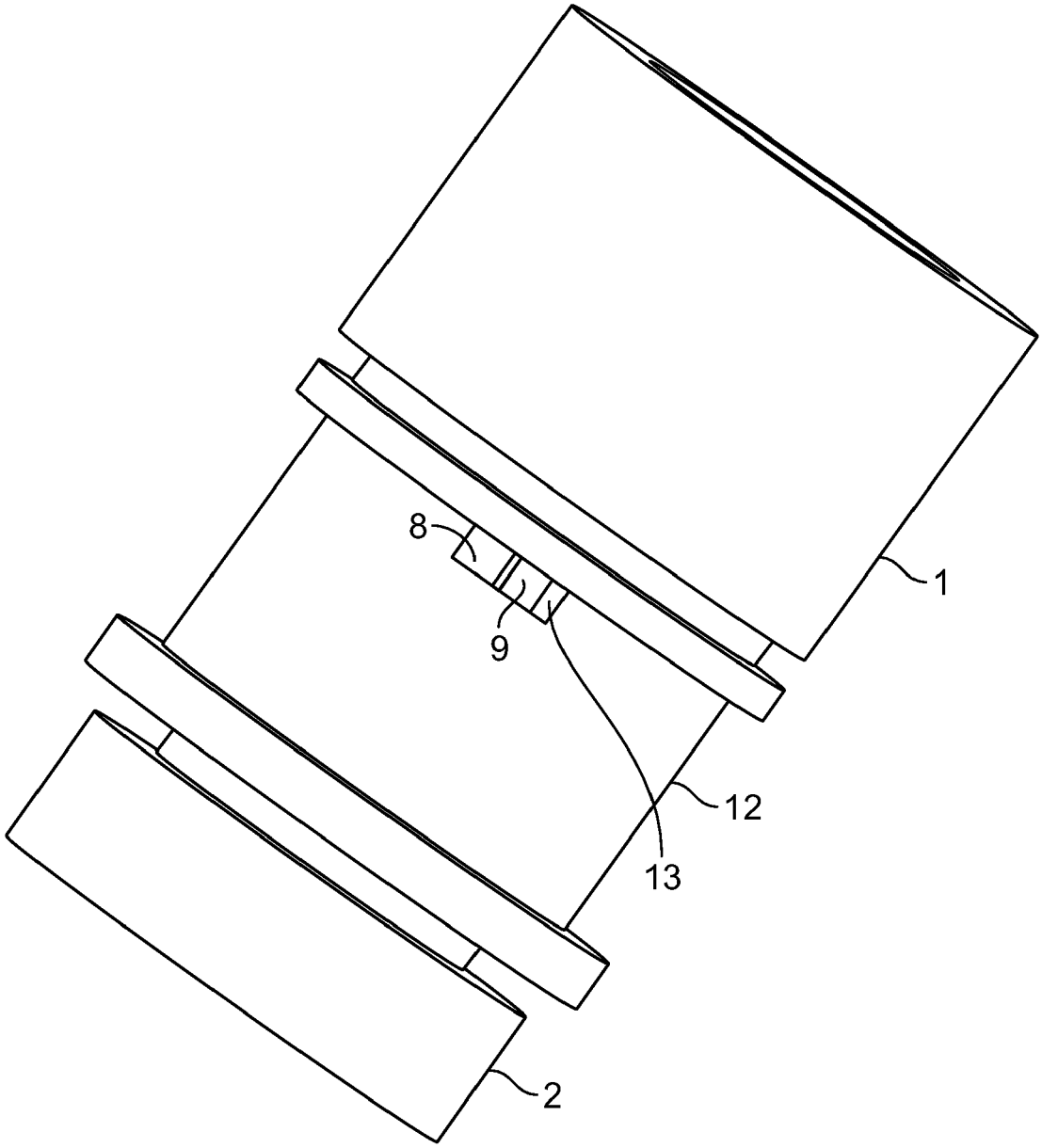
Figure 4:
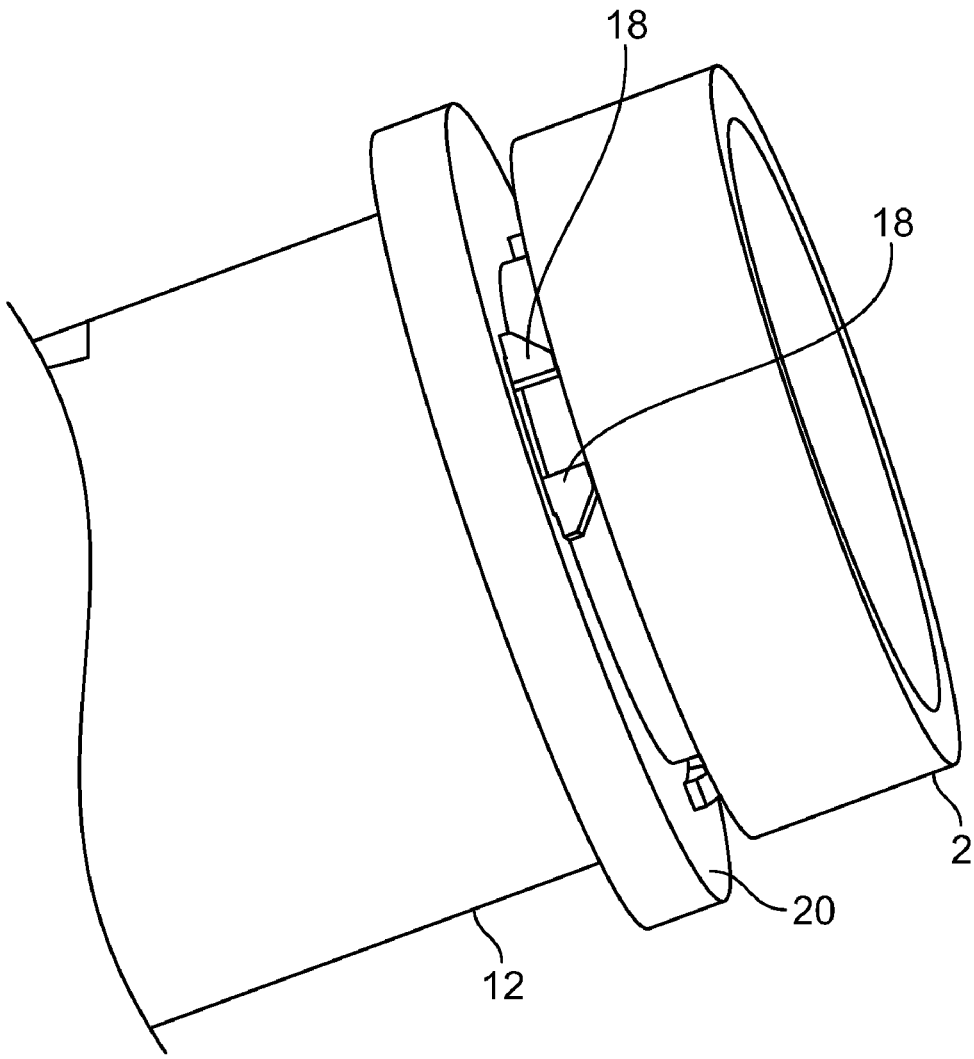
Figure 5:
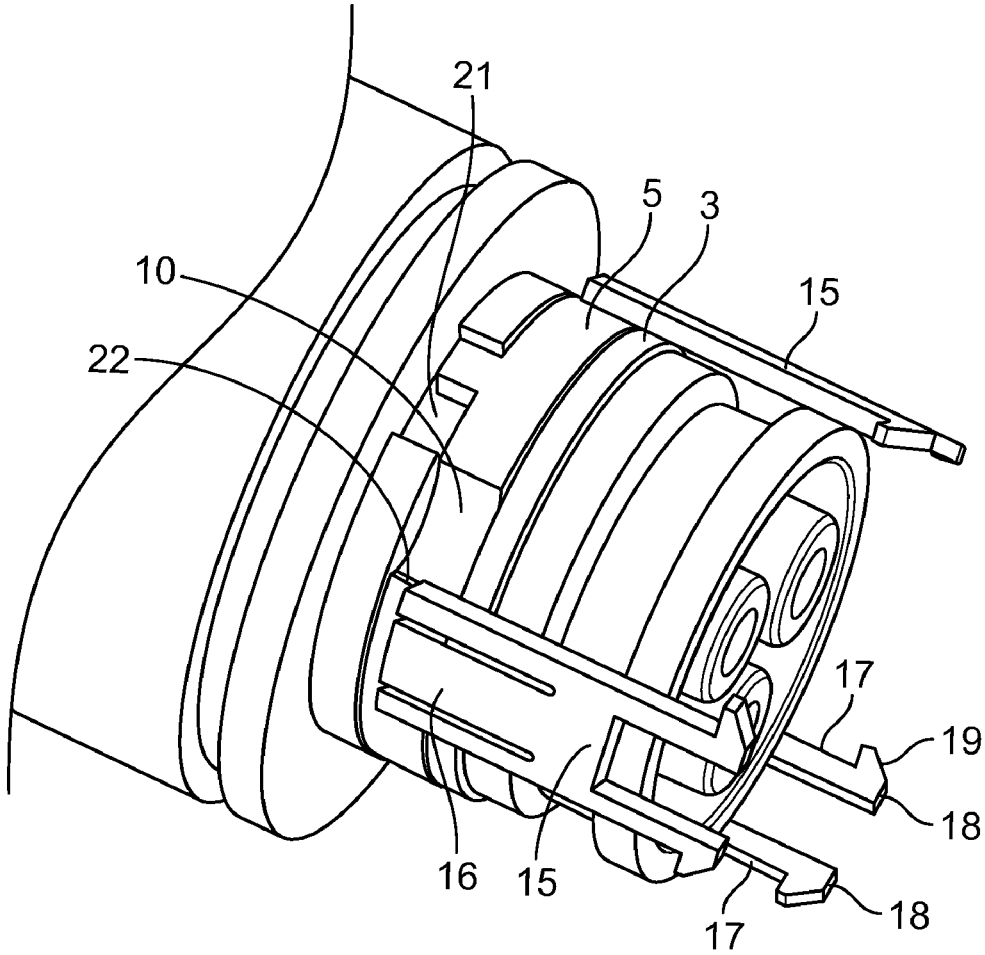

FIG. 1 shows a perspective view of the unlocking ring attached to the first connector element of the plug-and-socket connector according to the invention, FIG. 2 shows, in the same view as FIG. 1, the catch hooks inserted into the second connector element, FIG. 3 shows a perspective view of a plug-and-socket connector assembled from the two connector elements, FIG. 4 shows the anchoring of the catch hooks in the second connector element, FIG. 5 shows, in the same view as the other figures, the arrangement of the catch hooks relative to the first connector element and to the unlocking ring.

FIG. 1 shows a first connector element 1 of an electrical plug-and-socket connector which has an end section 3 with a reduced external diameter, in which by way of example three domes 4 are arranged, each of which contains a socket contact (not shown). The end section 3 is provided with an external circumambient groove in which an unlocking ring 5 is rotatably guided, so that the unlocking ring 5 adjoins a first shoulder 6 of the groove on the connection side. In the second shoulder 7 of the groove there is provided a recess 8, into which a projection 9 formed axially on the unlocking ring 5 projects. This projection, which serves as an unlocking member 9, can be moved within the recess 8, i.e. over a short portion of the periphery of the first connector element 1, the unlocking ring 5 turning with it by a corresponding short amount. The unlocking ring 5 furthermore has pockets 10 distributed uniformly across its periphery, one of which can be seen in FIG. 1. FIG. 1 furthermore shows a radial lip seal 11 which is pressed into a further circumambient groove arranged relatively close to the connection face of the first connector element 1.

FIG. 2 shows a second connector element 2, the connection face of which is designed such that the connector element 2 can be assembled with the first connector element 1 to form the plug-in connection, the end section 12 of the second connector element 2 coaxially surrounding the end section 3 of the first connector element 1 in the assembled state, cf. FIG. 3. There can be seen a window-like cutout 13 and also three inner grooves 14 extending axially in the end section 12, into each of which a catch hook 15 is inserted. The catch hooks 15 have on their insertion-side end an inward-protruding catch projection 16 in each case.

FIG. 3 shows the two connector elements 1 and 2 assembled to form a plug-and-socket connector. What is omitted in FIG. 3 for clarity, but shown in FIG. 4 in detail, is the end of a catch hook 15 opposite the catch projection 16. This opposite end is formed by two small legs 17, cf. FIG. 5, which each end in a laterally projecting anchoring projection 18. Upon assembly, the catch hooks 15 are each inserted with their legs 17, or the anchoring projections 18, which each have a chamfer 19, into the axially extending grooves 14 in the second connector element 2, the two legs 17 being pressed laterally together. As soon as the anchoring projections 18 are pushed through into the annular groove 20, the legs 17 with the anchoring projections 18 spring laterally open, so that the respective catch hook 15 is fixed in the second connector element 2.

The illustration of FIG. 5 shows in a simple manner the cooperation of the different parts of the locking means, the second connector element 2, in which the catch hooks 15 shown are actually located, being omitted to facilitate comprehension. What is shown is an unlocked state, indicated by the visualisation means 21—for example "open"—of the plug-and-socket connector, in which the inward-directed catch projections 16 of the catch hooks 15 lie on sections of the unlocking ring 5 which are not provided with pockets 10. The catch projections 16 are therefore not engaged. If the unlocking ring 5 is turned a few degrees to the left by means of the unlocking member 9, the catch projections 16 run over the incline 22 into the respective pocket 10 of the unlocking ring, where they catch behind the shoulder 6, on the connection side, of the circumambient groove, cf. FIG. 1. Then for example the visualisation means "closed" appears in the recess 8.

Since the plug-and-socket connector, as illustrated in FIG. 1, is sealed not on the end face but radially, the catch hooks 15 advantageously do not have to take up any tensile forces even when the plug-and-socket connector is closed. If the catch hooks 15 are formed with two material components, in particular with a catch projection 16 made of plastics material and legs 17 and also anchoring projections 18 made of metal, a high degree of heat dissipation is possible, which permits a greater current transmission capability.

The invention claimed is:

1. An electrical plug-and-socket connector including:

a first connector element having an end section and a locking means having an unlocking ring, the end section including an external circumambient groove, the unlocking ring having peripheral pockets and being rotatably guided in the external circumambient groove of the end section; and a second connector element having an end section with axially extending inner grooves and a catch hook provided in each groove and fixed to the second connector element, each catch hook having a connection side and an inward-projecting catch projection on the connection side, wherein in a locked state of the plug-and-socket connector the catch projections of the second connector element penetrate elastically into the pockets of the unlocking ring and in an unlocked state of the plug-and-socket connector the catch projections of the second connector element are pressed outwards by the unlocking ring, and wherein the end section of the second connector element has at least one window-like cut-out through which the unlocking ring is accessible and is adjustable to provide the locked state.

2. The electrical plug-and-socket connector according to claim 1, wherein the catch hooks each have at least one anchoring projection positioned opposite the catch projection, at least one anchoring projection being configured to anchor the catch hook in an external circumambient annular groove of the second connector element.

3. The electrical plug-and-socket connector according to claim 1, wherein three catch hooks are uniformly distributed on a periphery of the second connector element.

4. The electrical plug-and-socket connector according to claim 1, wherein an unlocking member which projects in axial direction is arranged on the unlocking ring, and wherein the unlocking member in the locked state of the plug-and-socket connector is configured to be actuated through the window-like cutout.

5. The electrical plug-and-socket connector according to claim 1, wherein transitions of the pockets to adjoining peripheral sections of the unlocking ring are formed obliquely at least to one side to provide an inclined thrust face that cooperates with the respective catch projection.

6. The electrical plug-and-socket connector according to claim 1, wherein the locking means is unlockable only with a tool.

7. The electrical plug-and-socket connector according to claim 1, wherein a circumambient radial seal is provided on the end section of the first connector element.

8. The electrical plug-and-socket connector according to claim 1, wherein the catch hooks include a plastics material at the catch-projection end and metal at the end opposite the catch-projection end.

* * * * *